United States Patent [19]

Wolske

[11] 4,292,033

[45] Sep. 29, 1981

[54] METHOD OF PROVIDING NET BAGS WITH WICKETING FLAPS

[75] Inventor: Eugene H. Wolske, Minnetonka, Minn.

[73] Assignee: Bemis Company, Inc., Minneapolis, Minn.

[21] Appl. No.: 113,825

[22] Filed: Jan. 21, 1980

Related U.S. Application Data

[62] Division of Ser. No. 860,290, Dec. 14, 1977, Pat. No. 4,207,983.

[51] Int. Cl.[3] ..... B31B 1/90; B31B 1/98

[52] U.S. Cl. ..... 493/221; 493/204; 493/226; 493/347; 493/925

[58] Field of Search ..... 93/35 R, 35 DS, 35 H, 93/35 MW, 93 HT, 33 H, DIG. 1, 8 WA; 206/554; 229/55, 69; 493/220–221, 226, 235, 239, 345–347, 381, 382, 334, 335, 267, 203, 204, 925

[56] References Cited

U.S. PATENT DOCUMENTS

| | | | |
|---|---|---|---|
| 2,177,117 | 10/1939 | Potdevin | 93/8 WA |
| 3,333,690 | 8/1967 | Marsh | 206/554 |
| 3,385,506 | 5/1968 | Ryburn | 229/55 X |
| 3,424,113 | 1/1969 | Dickmann | 93/93 HT X |
| 3,431,828 | 3/1969 | Crawford et al. | 93/93 HT X |
| 3,970,503 | 7/1976 | Yoshimura | 93/35 R X |
| 4,099,666 | 7/1978 | Welles | 229/62 |

*Primary Examiner*—James F. Coan

*Attorney, Agent, or Firm*—Senniger, Powers, Leavitt and Roedel

[57] ABSTRACT

A method of providing net bags with wicketing flaps at their mouth ends. A series of net bags are fed forward in a path with the bags extending transversely of the path and spaced longitudinally with their mouth ends aligned. As the bags are fed forward, a tape is secured to one wall of the mouth ends of the bags, extending from bag-to-bag and projecting beyond the mouth edge of the bag wall to a free edge spaced outwardly of the mouth edge of the bags. The tape is severed between the bags to provide a flap, the flap being adapted to receive a wicket for holding a plurality of the bags in stacked assembly.

13 Claims, 9 Drawing Figures

METHOD OF PROVIDING NET BAGS WITH WICKETING FLAPS

This is a division of application Ser. No. 860,290, filed Dec. 14, 1977, issued as U.S. Pat. No. 4,207,983, June 17, 1980.

BACKGROUND OF THE INVENTION

This invention relates to the packeting of net bags, more particularly to a method of making net bags constructed for stacking a plurality of the bags and holding the bags in assembly in the stack with fastening means such as a wicket.

This invention is especially concerned with packeting net bags, e.g., bags comprising a flat bag tube of net material having a bottom end closure comprising a length of tape folded around one end of the bag tube (constituting the bottom end of the bag) and secured to the tube. Reference may be made to Dickmann U.S. Pat. No. 3,424,113 showing apparatus for applying such bottom end closures to open-mesh bag tubes. The packeting is of a type referred to as wicket pack, in which a stack of bags is held in assembly by means of a U-shaped wire member or "wicket", which each successive bag adapted to be opened at its mouth for filling; and then separated from the stack. Reference may be made to such patents as U.S. Pat. Nos. 3,312,339, 3,329,260, 3,338,398 and 3,777,930 showing wicketed packets of bags made of sheet plastic material (e.g., polyethylene film) as distinguished from net, and U.S. Pat. No. 3,198,325 showing a packet of bags made of sheet plastic material with fastening means equivalent to a wicket. Unlike sheet plastic material (e.g., polyethylene film) used for bags, net material used for bags (e.g., knitted net material knit from narrow ribbons of polyethylene film) cannot be readily torn like film, and this has heretofore precluded packeting net bags in wicket-type packs.

The invention involves a method of providing net bags with wicketing flaps of the general type shown in the copending coassigned U.S. patent application of James R. Stricker, Ser. No. 825,984, filed Aug. 19, 1977, now abandoned. That application shows a bag made of net material knitted from strands constituted by narrow ribbons of high-density polyethylene film having opposed walls, closed at its bottom and open at its mouth edge, and having a flap comprising a strip of polyethylene film sealed to one of the walls of the bag, said strip having a portion projecting beyond the mouth edge of said one wall, and said projecting portion having a pair of holes therein for receiving the legs of a wicket.

SUMMARY OF THE INVENTION

Among the several objects of the invention may be noted the provision of an improved method of making net bags; and the provision of an improved method of providing net bags with wicketing flaps at their mouth ends. In the method of this invention, a series of net bags each having opposed walls and open at one end constituting its mouth end is fed forward one after another in a predetermined path with the bags extending transversely of said path and spaced longitudinally along said path with spaces between successive bags and with the mouth ends of the bags generally aligned. As the bags are fed forward a tape is secured to one wall of the bags with the tape extending horizontally of said path and transversely of the bags at the mouth ends of the bags.

The tape extends from bag-to-bag across the spaces between successive bags and overlaps and thereby projects beyond the mouth edge of said one wall of the bags to a free edge spaced outwardly of the mouth edge of the bags. The tape is severed between the leading bag of the series and the next bag thereby to separate the leading bag from the next bag. The leading bag has the separated portion of the tape secured to said one wall thereof as the said flap projecting beyond the mouth edge of said one wall of the bag.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
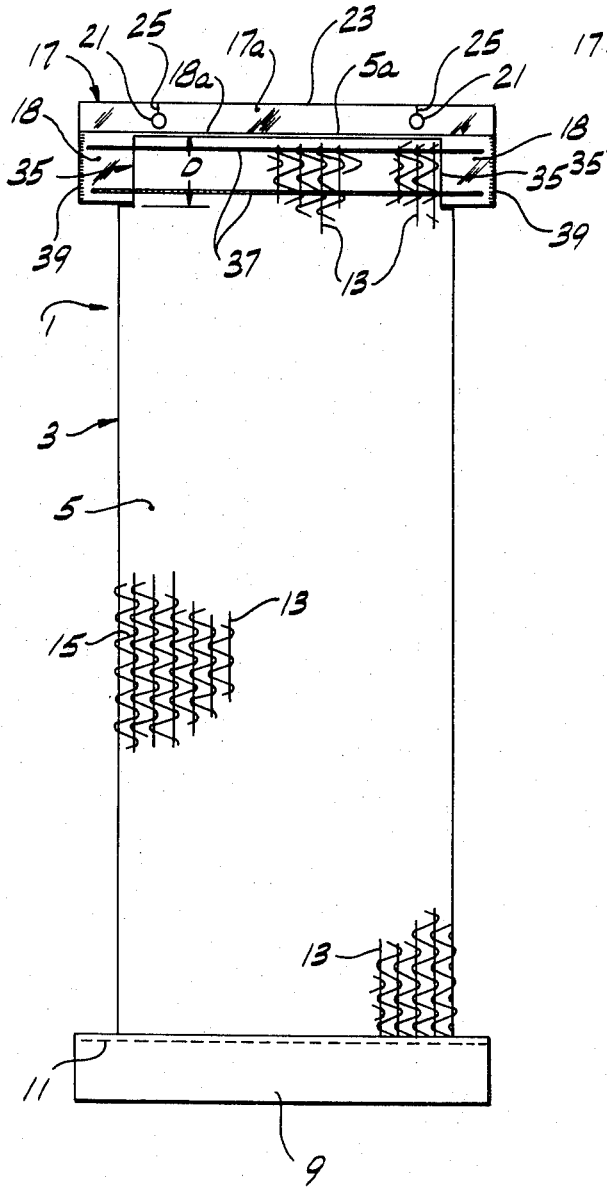
FIG. 1 is a front elevation of a bag made according to this invention.

Referring to the drawings, a bag made by the method of this invention, indicated in its entirety by the reference numeral 1, is shown to comprise a flat tube 3 of net material having opposed walls 5 and 7, closed at one end constituting its bottom end by a length of paper tape 9 folded around the bottom end of the tube and secured to the tube by stitching as indicated at 11. The tube is open at its other end, i.e., at its mouth end, where the end edges of the walls 5 and 7 are designated 5*a* and 7*a*, these edges being flush one with the other.

Figure 2:
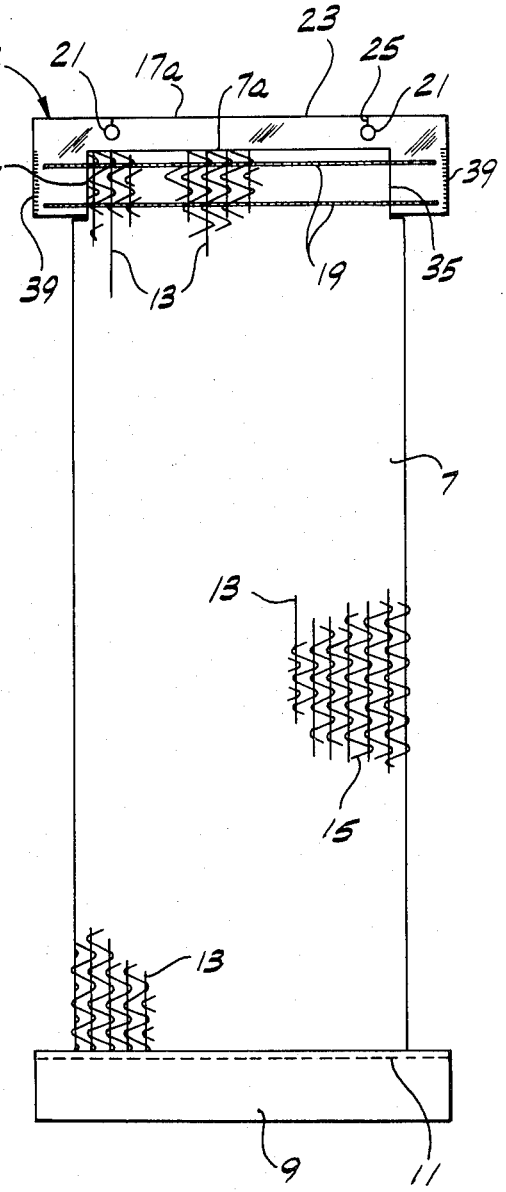
FIG. 2 is a back elevation of the bag.

As illustrated in FIGS. 1 and 2, the tube is formed of knitted net material, and is preferably formed of material knit from strands constituted by narrow ribbons of high-density polyethylene film. The particular knit construction illustration is a so-called Raschel knit construction, having double-strand wales 13 and zigzagging course yarns 15 between the wales, such as may be knit on a Sacorra knitting machine made by W. Barfuss & Co. of Mönchen-Gladbach, West Germany. It will be understood, however, that the tube may be formed of woven open-mesh material (e.g., leno-woven net) instead of knit material. The exact construction of the net material is not critical so far as this invention is concerned.

In accordance with this invention, one of the walls of the bag, herein the wall 7 (which may be referred to as the back wall of the bag), has a flap 17 extending beyond its open mouth edge 7*a* and beyond the mouth edge 5*a* of the other (front) wall 5. This flap comprises a piece of sheet material secured to the wall 7 of the bag and having a portion 17*a* projecting beyond the mouth edge 7*a* of the wall 7 adapted to receive fastening means for holding a plurality of the bags in a stack, with the flap of each bag being adapted to be torn off the fastening means. Further in accordance with this invention, a second piece of sheet material, designated 18, is secured to the other wall 5 of the bag (which may be referred to as its front wall) at the mouth edge of the bag. The projecting portion 17*a* of the flap 17 not only projects beyond the mouth edge 7*a* of the wall 7 but also projects beyond the lateral edge 18*a* of said second piece of material 18 at the mouth of the bag.

The flap 17 is constituted by a strip of sheet material extending across the wall 7 of the bag on the inside thereof and sealed to the wall 7 as indicated at 19. Preferably, the flap comprises a strip of heat-sealable plastic film, such as two mil polyethylene film, secured to the inside of wall 7 of the bag by adhering it thereto by means of stripes of hot melt adhesive indicated at 19 extending lengthwise of the strip (crosswise of the bag). The strip 17 has a pair of holes 21 punched in its projecting portion 17*a*, the holes being spaced transversely of the bag and located adjacent the outer lateral edge 23 of the strip for receiving fastening means, such as pins or the legs of a wicket, for holding a plurality of the bags in a stack, and enabling tearing off the strip (and hence the bag to which the strip is secured) from the means extending through the holes by tearing through the strip from the holes 21 to the outer lateral edge 23 of the strip. To facilitate the tearing, the strip may be suitably weakened as indicated at 25 on lines extending from the holes to its outer edge. As illustrated, the holes are adjacent the outside corners of the flap.

Figure 3:
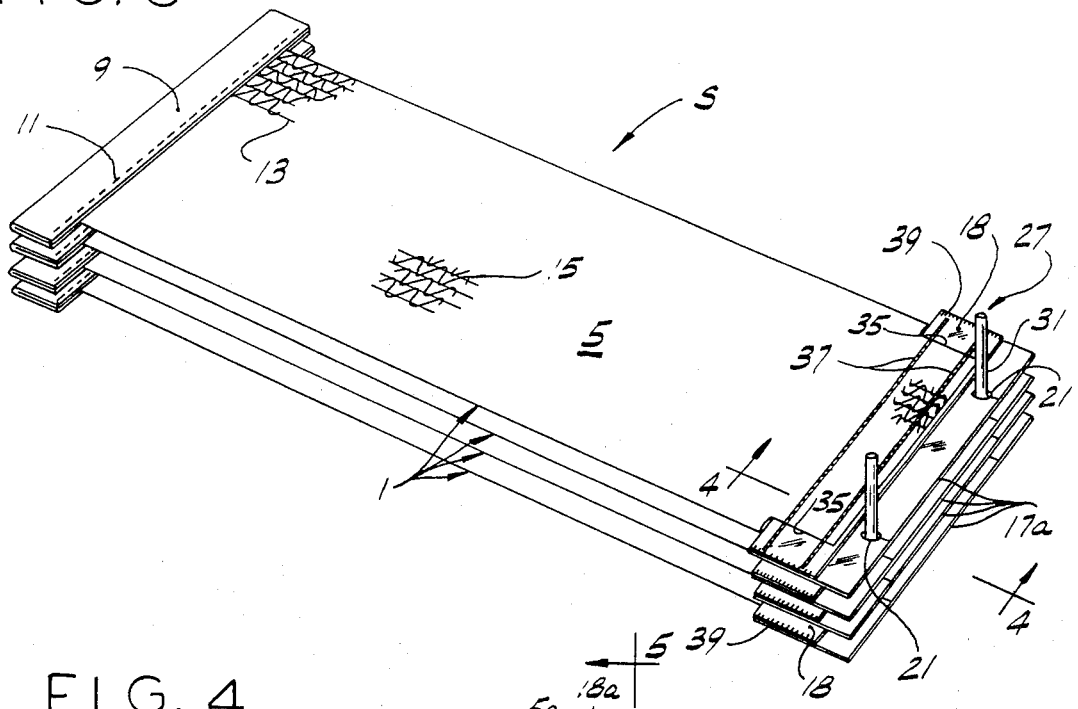
FIG. 3 is a perspective illustrating a wicketed stack of the bags.
Figure 4:
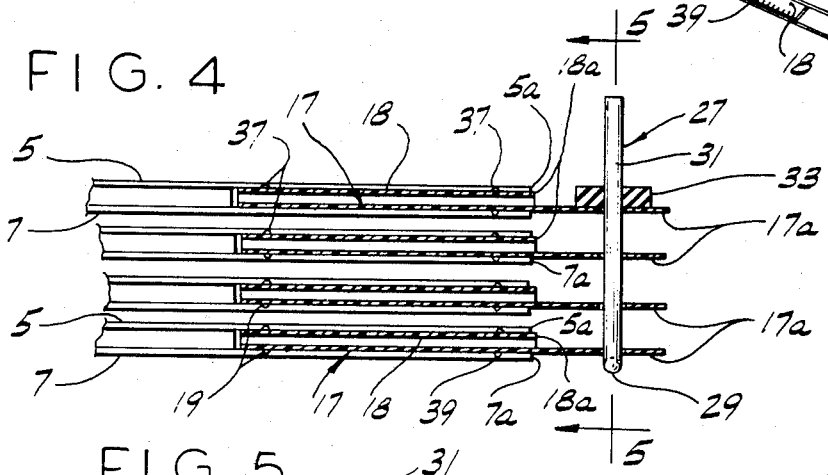
FIG. 4 is a section on line 4—4 of FIG. 3.
Figure 5:
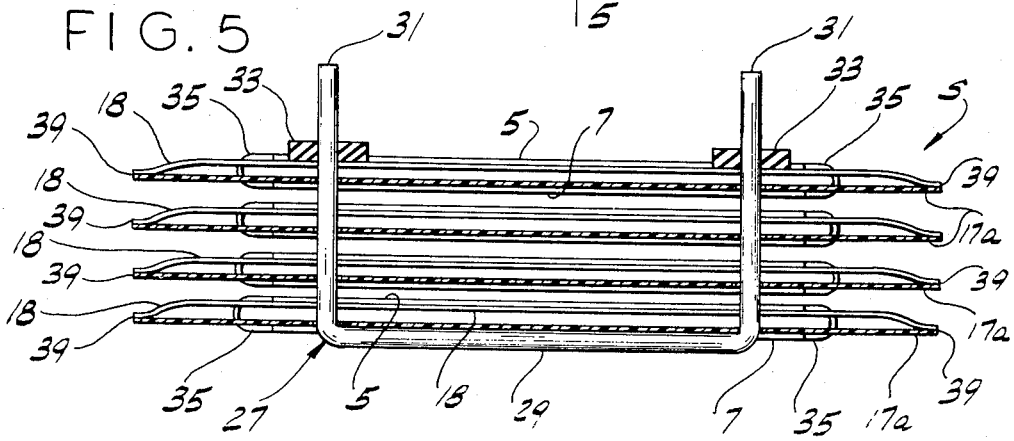
FIG. 5 is a section on line 5—5 of FIG. 4.

FIGS. 3–5 show a stack S of the bags 1 (only four bags being shown to simplify the drawing) in which the bags are stacked one on another with the back wall 7 of each bag against the front wall 5 of the next bag, and with the bag bottoms 9 one on another in the stack and the projecting portions 17*a* of the flap of the bags one on another in the stack with the holes 21 in alignment. The bags, thus stacked, are held together in the stack by fastening means shown in FIGS. 3–5 as comprising a wicket 27 having a cross bar 29 and legs 31, the cross bar 29 extending crosswise relative to the bags under the projecting portion 17*a* of the flap 17 of the lowermost bag of the stack and the legs 31 extending up through the holes 21 in the flap and projecting up above the flap of the uppermost bag. Any suitable means such as rubber washers 33 (see FIGS. 4 and 5; omitted in FIG. 3) may be applied to the legs 31 of the wicket overlying the flap of the uppermost bag to hold the bags on the wicket.

In one mode of use of a packet of bags such as shown in FIGS. 3–5, the stack of bags is transferred from the wicket to a pair of tubular pins (not shown) in a bag filling machine, the pins extending through the holes 21. The stack of bags is thereby held on the pins with each successive bag adapted to be opened at its mouth, separated from the stack for being filled by tearing its flap 17 off the pins, and then closed at its mouth as by means of a wire tie after it has been filled. It is also possible that the bags remain on the wicket when placed in a filling apparatus, in which case they are torn off the wicket.

The tube 3 is cut at its sides as indicated at 35 for a distance D down from its mouth end to separate the walls 5 and 7 of the tube at the sides of the tube for this distance D. In a typical bag wherein the tube 3 is about 23 inches long and 9 inches wide, the distance D is about 3 inches. The strip 17 extends across the inside of the back wall 7 of the bag and projects out beyond the sides of the bag through the cuts 35 for some distance (e.g., about one inch). In the typical bag mentioned, strip 17 may be about 11 inches long and $4\frac{1}{4}$ inches wide, projecting one inch beyond each side of the bag, set in about 3 inches into the bag (to the lower end of the cuts 35), its projecting portion 17*a* thereby being about $1\frac{1}{4}$ inches wide. The stated second piece of material 18 is constituted by a strip of sheet material, preferably a strip of heat-sealable plastic film such as two mil polyethylene film (the same as strip 17) of the same length as the strip 17 and of a width generally corresponding to the distance D. It extends across the inside of the front wall 5 with its lateral edge 18*a* at the mouth of the bag generally flush with the mouth edge 5*a* of the front wall 5, and projects out beyond the sides of the bag through the cuts 35 for the same distance as strip 17. Thus, the strip 18, having a width corresponding generally to the depth of the cuts 35, is set in about its full width into the bag on the inside of wall 5. The strip 18 is secured to the front wall 5 of the bag on the inside of the front wall by adhering it thereto by means of the stripes of hot melt adhesive indicated at 37 extending lengthwise of the strip 18 (crosswise of the bag). The strips 17 and 18 are heat-sealed together at their ends outward of the sides of the bag as indicated at 39.

Figures 6, 7, 8, 9:
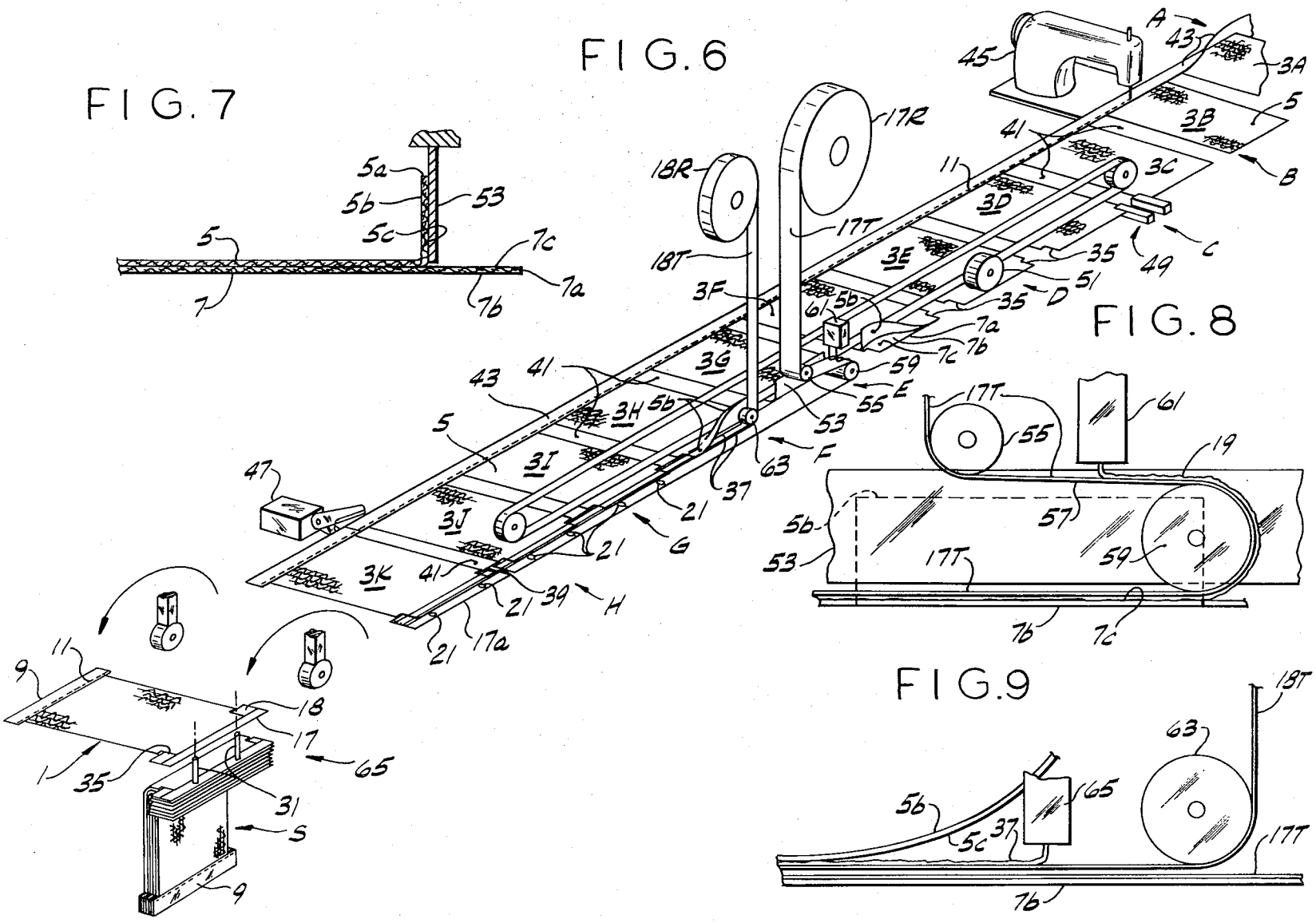
FIG. 6 is a perspective illustrating the method of this invention.
FIG. 7 is a section showing a detail of FIG. 6.
FIGS. 8 and 9 are views showing further details of FIG. 6.

FIG. 6 illustrates the method of this invention for providing the net bags (flat tubes 3 of net material) with the flap means of this invention (strips 17, 18), the method involving feeding forward a series of the bags one after another in a predetermined path with the bags lying flat in a horizontal plane extending transversely of said path and spaced longitudinally along said path, with spaces such as indicated at 41 between successive bags, and with the mouth ends of the bags generally aligned. In FIG. 6, bags 3A–3K are shown in the series. As illustrated, the top wall of each bag is the wall 5; the bottom wall is the wall 7.

As the bags are fed forward, a paper tape 43, which is to constitute the bottom closures or "headers" 9 of the bags, is folded around the bottom ends of the bag tubes at zone A and secured thereto by stitching 11 at zone B by means of a sewing machine indicated at 45. The folded paper tape 43 extends continuously of the series of bags, extending from bag to bag across the spaces 41 between successive bags. It is ultimately severed as by means of a clipper 47 between the leading bag 3K of the series and the next bag 3J of the series. Clipper 47 may move forward with the bags for some distance as they travel forward, being activated to cut the tape 43 as it moves forward, then being opened to be clear of the bags and returned to its initial position for the next cycle. The application of the header tape 43 to the bags as they go through the method of this invention for providing the bags with the flap means of this invention is not critical; the bags may be provided with the headers before or after the provision of the flap means. However, it is of some help in holding the bags in series.

As the bags or tubes 3 proceed through zone C (following zones A and B) in their path of travel, they are cut at their sides as indicated at 35 for the distance D inward from their mouth ends thereby to separate the walls 5 and 7 of each bag at the sides of the bag for this distance D in from its mouth end. The cutting may involve a notching of the bag at its sides at its mouth end, and results in walls 5 and 7 having mouth end portions 5*b* and 7*b* which are free of one another at the sides of the bag for the distance D, enabling the mouth end portion 5*b* of wall 5, which is the upper wall of the bag as it is fed forward, to be folded up to expose the inside face 7*c* of the mouth end portion 7*b* of the wall 7, which is the lower wall of the bag. The cutting of the sides of the bags at 35 may be effected by means of a dual cutting instrumentality 49 which moves forward with the bags for some distance as they travel forward, which is closed to notch the leading mouth end corner of one bag and the trailing mouth end corner of the next bag forward as it moves forward, and which is then opened to be clear of the bags and returned to its initial position for the next cycle. As shown in FIG. 6, the cutting instrumentality 49 acts during each cycle of its operation, on its forward stroke, to notch the leading (downstream) mouth end corner of the bag 3C of the series and the trailing (upstream) mouth end corner of the next bag 3D forward in the series. Thus, each bag proceeding on from zone C has the cuts or notches 35 at both its mouth end corners.

As each bag proceeds forward from zone C through a zone D, the free mouth end portion **5*b* of its upper wall 5 is folded up away from the mouth end portion 7*b* of the lower wall 7 to expose the inside face 7*c* of said mouth end portion 7*b* and to provide for entry between the mouth end portions 5*b* and 7*b* of a pair of tapes 17T and 18T to provide the strips 17 and 18 for the bags. This folding up of the mouth end portions 5*b* of the bags may be effected as by means of a roller 51 having a pressure-sensitive adhesive facing for picking up portion 5*b* and directing it behind a suitable guide 53 (see FIG. 7). The roller 51** may move forward with each bag for some distance as the bag travels forward, and then return to an initial position for the next cycle.

The tape 17T, which is of heat-sealable material such as polyethylene, for example, is fed into engagement with and secured to the inside face **7*c* of the mouth end portion 7*b* of the wall 7 of each bag in zone E. For this purpose the tape 17T is fed down from a supply wall 17R of the tape, under and rearward around a guide roll 55 so as to have a rearwardly traveling reach 57, and over and forward around a guide roll 59 which functions to press the tape down on the inside face 7*c* of mouth end portion 7*a* of wall 7. As the tape 17T travels through the reach 57 from roll 55 to roll 59, hot melt adhesive is applied to the upper face thereof by means such as indicated at 61 in two stripes 19 for adhering it to the inside face 7*c* of the mouth end portion 7*b*. The tape 17T is fed in such position laterally with respect to the path of travel of the bags as to overlap the mouth end of wall 7 of the bags and thereby project beyond the mouth edge 7*a* of portion 7*b* of wall 7. For the typical bag mentioned, the tape 17T would be $4\frac{1}{4}$ inches wide and laterally located so that its inner lateral edge is about 3 inches in from the mouth edge 7*a* of wall 7 and its outer lateral or free edge is spaced about $1\frac{1}{4}$ inches outward of edge 7*a*, thereby to project about $1\frac{1}{4}$ inches from edge 7*a* and provide a $1\frac{1}{4}$ inch flap 17*a***.

The tape 18T, also of heat-sealable material such as polyethylene, for example, is fed down from a supply roll 18R on the outside of the folded-up mouth end portions **5*b* of the bags and under and forward around a guide roll 63 located downstream from guide roll 59 in zone F. Immediately following (downstream from) zone F, the folded-up mouth end portion 5*b* of each bag is folded back down to its original flatwise position above mouth end portion 7*b*. Tape 18T travels forward from roll 63 underneath the folded down mouth end portions 5*b* of the bags. Hot melt adhesive is applied to the exposed upper face of the tape 18T in its reach which extends from roll 63 to the folded-down mouth end portion 5*b* of the bag downstream from roll 63 by means such as indicated at 65 in FIG. 9 in two stripes 37 for adhering it to the inside face 5*c* of mouth end portion 5*b*. The tape 18T is fed in such position laterally with respect to the path of travel of the bags that its outer lateral edge is generally flush with the mouth edge 5*a* of mouth end portion 5*b*** of the bags.

With the tapes 17T and 18T thus adhered by the stripes 19 and 37 of hot melt adhesive to the mouth end portions **7*b* and 5*b* of the bags, the bags proceed to travel through a zone G where the holes 21 (also the lines of weakness 25) are punched in the projecting portion 17*a* of the tape 17T**. The punching of the holes may be effected by a suitable punch which moves forward with the bags for some distance as they travel forward, being activated to punch the holes as it travels forward in unison with the bags, then being opened and returned to its initial position for the next cycle.

The bags then proceed through zone H, where the tapes 17T and 18T are severed and heat-sealed together at 39 between the leading bag 3K of the series and the next bag 3J, thereby to separate the bag at 3K from the next bag at 3J. As indicated in FIG. 6, the severing may be on a single line in the space 41 between bags, thus leaving portions of the tapes extending beyond the sides of the bag as appears in FIGS. 1 and 2. It could be such as to remove substantially all or part of the portions of the tapes between bags. The severing and sealing may be effected by means of a heated severing and sealing instrumentality which moves forward in unison with the bags for some distance as they travel forward, closes on the tapes as it moves forward to effect the severing and sealing, then opens and returns rearward to its initial position for the next cycle.

Finally, as each bag at 3K is separated from the next bag at 3J, it is wicketed by means of conventional wicketing apparatus indicated at 65 in FIG. 7 to form a wicketed packet such as the wicketed stack of FIGS. 3–5.

In view of the above, it will be seen that the several objects of the invention are achieved and other advantageous results attained.

As various changes could be made in the above methods without departing from the scope of the invention, it is intended that all matter contained in the above description or shown in the accompanying drawings shall be interpreted as illustrative and not in a limiting sense.

What is claimed is:

1. The method of providing net bags with flap means, each bag having opposed walls and being open at one end constituting its mouth end, each wall thereby having a mouth edge, the flap means being provided at the mouth end of the bag, comprising:

feeding forward a series of said bags one after another in a predetermined path with the bags extending transversely of said path and spaced longitudinally along said path with spaces between successive bags and with the mouth ends of the bags generally aligned;

securing a tape to one wall of the bags as they are fed forward with the tape extending longitudinally of said path and transversely of the bags at the mouth ends of the bags, the tape extending from bag-to-bag across the spaces between successive bags and overlapping the mouth end of said one wall of the bags, the tape projecting beyond the mouth edge of said one wall of the bags to a free edge spaced outwardly of the mouth edge of the bags; and severing the tape between the leading bag of the series and the next bag thereby to separate the leading bag from the next bag, with the leading bag having the separated portion of the tape secured to said one wall thereof as a flap projecting beyond the mouth edge of said one wall of the bag, the portion of the flap projecting beyond the mouth edge being adapted to receive means for holding a plurality of the bags in stacked assembly, the flap of each bag being adapted to be torn off said holding means.

2. The method of claim 1 wherein a pair of holes is formed in the portion of the tape constituting the said flap, the holes being adapted to receive means, such as the legs of a wicket, for holding a plurality of the bags in a stack.

3. The method of claim 2 wherein the holes are punched in the tape as it is fed forward with the bags.

4. The method of claim 3 wherein the holes are punched in the tape after it has been secured to the said one wall of the bags.

5. The method of claim 3 wherein the tape is secured to the bags by applying adhesive between the tape and the said one wall of the bags.

6. The method of claim 5 wherein the adhesive is a hot melt adhesive and is applied in a melted state.

7. The method of claim 1 wherein a second tape is secured to the other wall of the bags as they are fed forward with the second tape extending longitudinally of said path and transversely of the bags, and the second tape extending from bag-to-bag across the spaces between successive bags and having its outer lateral edge spaced inward from the outer lateral edge of the first tape so that the first tape provides the said flap projecting beyond the lateral edge of the second tape at the mouth of the bag, the second tape being severed along with the first tape.

8. The method of claim 7 wherein the second tape is secured to said other wall of the bag with its outer lateral edge generally flush with the mouth edge of said other wall of the bag.

9. The method of claim 1 wherein, as the bags are fed forward, each bag is cut at its sides for a distance to separate the walls of the bag at the sides for said distance, the portions of the walls of each bag at its mouth end so separated from one another being opened up, and said tape being fed into engagement with and secured to the inside face of the said portion of the said one wall.

10. The method of claim 9 wherein a second tape is fed into engagement with and secured to the inside face of the said portion of the other wall, said portions with the tapes being reclosed and both tapes being severed between the leading bag of the series and the next bag thereby to separate the leading bag from the next bag, the second tape having its outer lateral edge spaced inward from the outer lateral edge of the first tape so that the first tape provides the said flap projecting beyond the lateral edge of the second tape at the mouth of the bag, the second tape being severed along with the first tape.

11. The method of claim 10 wherein the said portion of the other wall is folded away from the said portion of said one wall to open up said portions and then folded back, the first tape being fed on to the inside face of the said portion of said one wall where the said portion of said other wall is folded back, the second tape being fed under the said portion of said other wall after it has been folded back.

12. The method of claim 11 wherein the tapes are heat-sealable, and are severed and heat-sealed together between the leading bag and the next bag.

13. The method of claim 12 wherein holes are punched in the first tape after the said portion of said other wall has been folded back.

* * * * *